US008065894B2

(12) United States Patent
Yanagi et al.

(10) Patent No.: US 8,065,894 B2
(45) Date of Patent: Nov. 29, 2011

(54) DOUBLE KNIT FABRIC HAVING SUPERIOR RUN OR CURLING GENERATION PREVENTING ABILITY AND A METHOD FOR PROCESSING THE DOUBLE KNIT FABRIC

(75) Inventors: Katsuhiko Yanagi, Fukui (JP); Hidenori Tsujikawa, Fukui (JP); Kiyotake Kishimoto, Fukui (JP)

(73) Assignee: Seiren Co., Ltd., Fukui (JP)

( * ) Notice: Subject to any disclaimer, the term of this patent is extended or adjusted under 35 U.S.C. 154(b) by 0 days.

(21) Appl. No.: 12/664,007

(22) PCT Filed: Jul. 14, 2008

(86) PCT No.: PCT/JP2008/063082

§ 371 (c)(1),
(2), (4) Date: Dec. 10, 2009

(87) PCT Pub. No.: WO2009/011440

PCT Pub. Date: Jan. 22, 2009

(65) Prior Publication Data

US 2010/0170300 A1 Jul. 8, 2010

(30) Foreign Application Priority Data

Jul. 13, 2007 (JP) ..... 2007-185070

(51) Int. Cl.
*D04B 9/00* (2006.01)

(52) U.S. Cl. ..... 66/196; 66/169 R

(58) Field of Classification Search ..... 66/169 R, 66/170, 171, 172 R, 196
See application file for complete search history.

(56) References Cited

U.S. PATENT DOCUMENTS

| | | | | |
|---|---|---|---|---|
| 6,722,164 | B1 * | 4/2004 | Ives et al. | 66/195 |
| 6,776,014 | B1 * | 8/2004 | Laycock et al. | 66/198 |
| 7,240,522 | B2 * | 7/2007 | Kondou et al. | 66/195 |
| 7,465,683 | B2 * | 12/2008 | McMurray | 442/314 |
| 7,634,924 | B2 * | 12/2009 | Chuang et al. | 66/198 |

FOREIGN PATENT DOCUMENTS

| | | |
|---|---|---|
| JP | 61-11265 | 4/1986 |
| JP | A 61-207682 | 9/1986 |
| JP | A 63-28971 | 2/1988 |
| JP | A 7-102454 | 4/1995 |
| JP | A 2002-339268 | 11/2002 |
| JP | A 2003-201654 | 7/2003 |
| JP | A 2003-342169 | 12/2003 |
| JP | A 2004-52157 | 2/2004 |
| JP | A 2005-113349 | 4/2005 |
| JP | U 3122471 | 6/2006 |

* cited by examiner

*Primary Examiner* — Danny Worrell
(74) *Attorney, Agent, or Firm* — Greer, Burns & Crain, Ltd.

(57) ABSTRACT

A double knit fabric which does not require hemming treatment even when it is cut into a desired shape and does not give any damage on handling to the fabric when an user wears it, and which can suppress generation of run or curling. A double knit fabric having a superior run and curling generation preventing ability, is made by a knitting process utilizing a non-elastic yarn and an elastic yarn having thermal deformation starting temperature being 150° C. to 190° C., with a plating stitch so that the non elastic yarn is arranged on both external surfaces thereof, while the elastic yarn is arranged on both inner surfaces thereof.

7 Claims, No Drawings

DOUBLE KNIT FABRIC HAVING SUPERIOR RUN OR CURLING GENERATION PREVENTING ABILITY AND A METHOD FOR PROCESSING THE DOUBLE KNIT FABRIC

This application is a U.S. National Phase under 35 U.S.C. §371 of International Application No. PCT/JP2008/063082, filed Jul. 14, 2008.

TECHNICAL FIELD

The present invention relates to a double knit fabric which requires no after treatment after cutting of the double knit fabric (hemming less characteristic), and having superior ability to prevent run, laddering or curling from being generated from a cut end portion of the knit fabric.

BACKGROUND OF THE INVENTION

Generally speaking, a cut end portion of a clothing or a garment especially made of a weft knitting fabric possibly has a defect portion such as a yarn fray (caused by a yarn releasing or a yarn dropping), a yarn projection, a curling, or a defected portion having a ladder like configuration, that is to say a run, which is continually generated along an array of knitting loops caused by some of the knitting loops being released from another knitting loops in a wale direction of the weft knitting fabric, when no after-treatment has been performed on the cut edge portion of the knit fabric.

Therefore, as an after-treatment for the cut edge portion thereof, the following after treatment methods are generally used, such as, a sewing method with using an overlocking machine, a hemmingmethod, a method for sewing the cut edge portion together with a lace fabric, a thermal fixing method with a seam tape or the like or a piping method with utilizing a separate fabric (patch fabric).

However, the operations for the above-mentioned after-treatments (after-processing) generally require a lots of processing steps so as to cause the costs thereof to be increased and additionally, especially regarding a good such as an underwear or an undershirt which directly contacts to a human skin, since a part of the good which has been treated by the above-mentioned after-treatment, would sometimes become thick or hard.

Accordingly, since a part of the skin of an user to which the cut edge portion to which the above-mentioned after-treatment has been performed, is directly attached, or an area in the vicinity of the part of the skin of the user, is pressed or rubbed or becomes stuffy, it becomes problem for the user to feel itch or to be suffered from skin roughness.

Further, since a projected portion of the hem line is sometimes reflected partly on an outerwear, another problem in which an aesthetical characteristic of a wear is worsened is arisen.

Additionally, although a part member used for a pocket or a fastener is also sewn on the clothing, a yarn fray (caused by a yarn releasing or a yarn dropping) and a yarn projection generated at an end portion of the part member which is attached to the clothing, also become a problem.

In order to overcome the above-mentioned problems, for example, Japanese Unexamined Patent Publication (KOKAI) No. 2003-201654 (Patent Document No. 1), discloses an elastic warp knit fabric having an ability of preventing loop drop from being generated, and which is knitted by feeding a non-elastic yarn and an elastic yarn in parallel to each other with knitting at least one of these knitting yarns so as form a closed loop (a silk lap) and further which is knitted so as to make its width to be narrow and to increase an amount of yarns with controlling the runners in order to obtain a stability of the fabric.

However, since this knit fabric is a warp knit fabric, it is generally difficult to set the elongations both in a warp yarn direction and in a weft yarn direction of the warp knit fabric with a well balanced condition, and thus an elongation in one direction thereof is possibly suppressed so that the fabric shows a tensioned feeling whereby when such warp knit fabric is used for an innerwear or the like, fitness of wearing thereof is deteriorated.

Additionally, it is generally spoken that since a warp knit fabric is not usually able to show soft feeling, the warp knit fabric shows a problem to have a coarse feeling as an underwear.

Japanese Unexamined Patent Publication (KOKAI) No. 61-207682 (Patent Document No. 2), discloses a method to prevent a run that is to say a stripe like defect caused by a fray of knitting loops from being generated in a circular weft knitting fabric by previously applying water in-soluble resin at an end portion of the circular weft knitting fabric, in performing a dyeing and finishing process to the weft knitting fabric.

However, this method would also raise a further problem in which a good handling of the circular weft knitting fabric would be lost by applying the resin thereto as well as this method further would have a problem in a durability of the weft knitting fabric.

Japanese Unexamined Patent Publication (KOKAI) No. 2005-113349 (Patent Document No. 3), discloses a garment made of knit fabric having fray generation preventing ability by being knitted with a thermal fusible elastic yarn such as a low melting point polyurethane elastic yarn and a yarn other than the thermal fusible elastic yarn utilizing a plating stitch and which having at least one opening, a part of or an overall of a peripheral edge of which having a curved configuration and a cut end free configuration without being treated by any of the after treatment.

However, it raises further problem that the knitted fabric or the garment made by such knitted fabric shows its handling to be coarse.

Japanese Unexamined Patent Publication (KOKAI) No. 63-28971 (Patent Document No. 4), discloses a technology in that a yarn or a fiber used in a textile knitting or weaving fabric cannot be easily dropped out from the fabric by applying a needle punching operation to the fabric with utilizing the barbed needles as a loop fixing means so as to entangle the fibers or yarns with each other at an intersecting point formed by a warp yarn and a weft yarn of the fabric followed by a felting operation with applying water thereto.

However, under this method, the fabric cannot have sufficient durability as well as sufficient fray generation preventing effect and run generation preventing effect cannot be obtained.

Japanese Unexamined Patent Publication (KOKAI) No. 2004-52157 (Patent Document No. 5), discloses a technology in that only the polyurethane elastic yarns are used in a front surface and a back surface of a knit fabric, so as to obtain a stretchable knit fabric having superior stretched ability and superior fray generation preventing characteristic so that the stretchable knit fabric can be used as a garment with leaving a hem portion under a cut out free condition.

However, in this technology, although it is easy to obtain a knit fabric having a sufficient elongation, size stability and configuration maintenance ability of the knit fabric made only by polyurethane elastic yarns are deteriorated without fully taking the knitting stitches configuration into account.

SUMMARY OF THE INVENTION

Accordingly, the object of the present invention is to resolve the above-mentioned conventional problems and to provide a double knit fabric which does not require any hemming treatment even when the knit fabric is cut out into any desired shape and does not give any damage on handling to the knit fabric even when an user wears it as it is as well as which can suppress such generation of a run or a curling.

And further, the double knit fabric of the present invention can resolve the problem which has always been a target one to be resolved in a circular knit fabric, heretofore, in which a run is generated, and as well as can provide a clothing material having curling generation preventing ability by knitting it with the elastic yarns arranged in both surfaces of the knit fabric and by taking a balance in yarn tension applied among the loops arranged in both surfaces of the knit fabric.

In order to attain the above-mentioned object of the present invention, the present invention basically adopts the following technical features as shown hereunder.

After many intentional researches and developments in order to overcome the above-mentioned problems, the present invention has succeeded to provide a double knit fabric which can be used for a material of garments without using any elastic yarns having low melting temperature and which can be used under just cut out condition without performing any hemming treatment thereto as well as which hardly generates a run and curling at the cut out edge thereof.

Note that, a first aspect of the present invention is a double knit fabric having a superior run and curling generation preventing ability by knitted with a non-elastic yarn and an elastic yarn having thermal deformation starting temperature being 150° C. to 190° C., with utilizing plating stitch so that the non elastic yarn is arranged on both external surfaces of the double knit fabric, while the elastic yarn being arranged on both inner surfaces thereof, and further wherein a ratio of a size of the elastic yarn as used in the knit fabric to that of the non-elastic yarn as used in the knit fabric, being 1:0.3 to 1:3.0, and an extension rate of the knit fabric being 180% or more, while an extension recovery factor thereof being 92% or more, as well as a product of a warp density and a weft density of the knit fabric being 5000/square inch or more.

On the other hand, a second aspect of the present invention is a double knit fabric which is further characterized in that a peeling strength of a portion on which the elastic yarns are contacted with each other, being 10 cN to 17 cN.

A third aspect of the present invention is a double knit fabric having the above-mentioned configuration and which is further characterized in that the knit fabric is produced with utilizing a knitting stitch configuration based on an interlock stitch.

In addition, a fourth aspect of the present invention relates to a method to process a double knit fabric having the above-mentioned configuration and the processing method comprising a step of treating the double knit fabric with a treatment liquid including sulfonate and a step of heat-setting the double knit fabric thus treated at the temperature of 195° C. to 205° C.

As mentioned above, the present invention can provide a double knit fabric which can be used for a material of garments which does not require any of the hemming treatments for preventing the fray on the cut out edge portion from being generated, and which can suppress to generate the run and curling without deteriorating the handling of the double knit fabric.

DETAILED DESCRIPTION OF THE INVENTION

The specific embodiments of the double knit fabrics and the method for processing the double knit fabrics of the present invention will be explained hereunder.

Note that, the double knit fabric of the present invention is the one having a superior run and curling generation preventing ability by knitted with a non-elastic yarn and an elastic yarn having thermal deformation starting temperature being 150° C. to 190° C., with utilizing plating stitch so that the non elastic yarn is arranged on both external surfaces of the double knit fabric while the elastic yarn is arranged on both inner surfaces thereof, and further wherein both yarns are preferably fed simultaneously to each one of the dial needles and the cylinder needles, respectively, from the same feeder.

In order to attain the above-mentioned object of the present invention, it is preferable that a yarn feeding eye for feeding the non-elastic yarn and a yarn feeding roller for feeding the elastic yarn are provided on the same feeder on a double knit fabric forming position of a double circular knitting machine.

And further, the yarn feeding roller should be adjusted to have a yarn feeding angle so as to make it possible to feed the elastic yarn with stable condition so that a knit fabric can be knitted with a constantly adjusted yarn feeding tension.

By doing this, it becomes possible to provide a double knit fabric in which the loops formed by the non-elastic yarn are arranged on both external surfaces of the double knit fabric, while the loops formed by the elastic yarn are arranged on both inner surfaces thereof.

Regarding an arrangement of the yarn feeding roller, the yarn feeding roller is mounted on the knitting machine in order to feed the elastic yarn to both the dial needles and the cylinder needles simultaneously and in parallel with the non-elastic yarn which is arranged on the external surfaces of the knit fabric (a ground yarn) and thus the knitting operation is carried out by setting an mounting angle of the yarn feeding roller at a desired angle.

On the other hand, in the knit fabric of the present invention, in order for both of the elastic yarn and the non-elastic yarn to be knitted with a plaiting stitch at all of the feeders, it is preferable that the super fine knitting needles (having a needle thickness of 0.25 mm) having a high butt and the super fine knitting needles (having a needle thickness of 0.25 mm) having a low butt are alternately arranged on both of the cylinder and the dial of a double knitting machine.

More over, it is further preferable that the fine knitting needles having the high butt are selected at even number of the feeders with a cam mechanism, while the fine knitting needles having the low butt are selected at odd number of the feeders with a cam mechanism.

Further, in the present invention, regarding a yarn size ratio of the yarns to be used in the knit fabric, a ratio of a size of the elastic yarn as used in the knit fabric to that of the non-elastic yarn as used in the knit fabric, being 1:0.3 to 1:3.0.

Note that when the ratio of the non-elastic yarn is less than 0.3, a defect of a knit fabric, such as "memuki" in Japanese, in which some portions of the elastic yarns come out on an external surface of the knit fabric, is easily generated causing to arise a problem in that an external appearance and a handling of the knit fabric are deteriorated.

On the other hand, when the ratio thereof exceeds 3.0, a problem in that the generation of the run is not sufficiently suppressed, would be arisen.

Further, regarding a yarn size of the yarn to be used in the present invention, the yarn size of the elastic yarn is preferably less than 33 dtex, while the yarn size of the non-elastic yarn is preferably less than 33 dtex.

On the other hand, the double knit fabric of the present invention preferably has a density of 120 courses/inch or more and a density of 100 wales/inch or more, under a raw knit fabric.

By using the knit fabric with the above-mentioned density, a double knit fabric having a superior run or curling generation preventing ability can be obtained.

In addition to thereabove, in order to obtain the knit fabric having the above-mentioned density, it is prefer to use a double knit fabric knitting machine having a gauge of 36 or exceeding 36.

Further, it is also preferable that a product of a warp density and a weft density of the double knit fabric used for an end product is 5000/square inch or more in order to improve a durability with respect to a generation of the run under a stretched condition.

Note that the higher a value of the product of a warp density and a weft density of the double knit fabric is, the more the tension applied to one loop when the knit fabric is stretched in both weft direction and warp direction is reduced so as to cover a weak loop retaining force and to suppress a generation of the run.

From the various experimental results obtained by the inventors of the present invention after having performed various kinds of experiments, they have confirmed that when the product of a warp density and a weft density of the double knit fabric is 5000/square inch or more, the run generation preventing effect on the double knit fabric can be obtained.

And further, it is acknowledged that the double knit fabric of the present invention is preferably knitted basically with an interlock stitch, and by doing this, a double knit fabric having a front surface and a back surface, each having a surface configuration being identical to each other, and having a smooth surface and having an appropriate stretch characteristic, can be obtained.

And in the present invention, both of the extension rates of the double knit fabric in the weft direction and in the warp direction are 180% or more.

Note that when the extension rate thereof is less than 180%, it would be assumed that a feeling of wearing of the knit fabric would be deteriorated.

Further, in the present invention, an extension recovery factor of the double knit fabric, is 92% or more.

Note that when the extension recovery factor thereof is less than 92%, it would be assumed that a feeling of wear fitting and a shape retaining characteristic of the knit fabric would be deteriorated.

And further, in the present invention, the double knit fabric thus obtained is preferably processed with a treatment liquid including sulfonate and then it is heat-set at the temperature of 195° C. to 205° C.

Note that when the temperature as used in the heat-set procedure is less than 195° C., the effect of the heat-set would not be sufficient so that the curling would be generated, while when the temperature as used in the heat-set procedure is higher than 205° C., the knit fabric per se would be degraded.

However, by processing the double knit fabric with sulfonate, even when the knit fabric was thermal treated with a temperature of 195° C. to 205° C., a degradation of the non-elastic yarn or a generation of yellowing thereof can be suppressed so that a heat-set ability of the elastic yarn can be improved causing to suppress the generation of the curling in the double knit fabric.

As the elastic yarn which can be used in the present invention, a polyester based elastic yarn and a polyurethane based elastic yarn are available but the polyurethane based elastic yarn is preferable from a point of view of heat resistance.

In addition, by using the polyurethane based elastic yarn having the thermal deformation starting temperature being 150° C. to 190° C., there becomes a less opportunity for the elastic yarns to show complete thermal adherences among them when they are processed and further, even when the heat set temperature is set relatively higher than the usual one in order to suppress the generation of the curling, the opportunity of the elastic yarns to be degraded or for the elongation or the strength of the elastic yarns to be deteriorated, becomes small.

And further, by using such kind of elastic yarns, a peeling strength of a portion on which the elastic yarns are contacted with each other in the knit fabric, can be easily set at 10 cN to 17 cN, so that a double knit fabric having a characteristic in which the run or the curling is hardly generated without deteriorating the handling and the stretch ability of the knit fabric.

In the double knit fabric of the present invention, from the various experimental results, the inventors of the present invention have acknowledged the facts that when the peeling strength is less than 10 cN, there is a problem in which sufficient run generation preventing effect cannot be obtained, as well as when the peeling strength is more than 17 cN, there is another problem in which the handling of the knit fabric becomes coarse or the stretch ability thereof is deteriorated.

More over, the non-elastic yarns which can be used in the present invention are the synthetic yarns selected from a group of polyester yarn, nylon yarn, acrylic yarn, polyvinyl alcohol yarn or the like, the regenerated yarn such as a rayon yarn, and the natural yarns made by cotton, wool, linen, silk or the like, or the yarns made by a plurality of different kinds of the fibers or the yarns as a composite yarn.

A preferable embodiment of the present invention is a knit fabric made by either one of a polyester yarn, a nylon yarn or a cellulose yarn and which is treated with a treatment liquid including sulfonate, and note that this kind of knit fabric can suppress the yarn degradation including a generation of yellowing, even when the knit fabric has been thermal treated at the temperature of 195° C. to 205° C.

EXAMPLES

Hereunder, the present invention will be further precisely explained based upon the several embodiments but it is apparent that the present invention does not restricted only to these examples.

Further note that each one of the characteristic values as shown in each one of the examples is measured by the following measuring methods, respectively.

(1) Evaluation of the Extension Rate of a Knit Fabric:

The three test specimens each having a vertical length of 16 cm and a lateral length of 2.5 cm and the three separate specimens each having a vertical length of 2.5 cm and a lateral length of 16 cm have been prepared.

Then, by using a constant rate of extension type tensile tester, (made by SHIMAZU SEISAKUSHO CO., LTD.), having the gripping members for gripping the test specimen and each of which comprising a chucking jig with teeth like configuration, the elongation of each one of the test specimens has been measured with a measuring method comprising steps of;

grasping each one of the specimens between an upper gripping member with an upper gripping length of 2.5 cm and a lower gripping member with a lower gripping length of 3.5 cm;

setting a distance formed between the upper and the lower gripping members at 10 cm;

setting the test specimen grasping pressure at 490 kPa;

moving at least one of the gripping members in a direction away from an opposite gripping member with the tensile rate of 30 cm/min: and measuring an elongation at a time when a load applied on the specimen to be tested, has reached at 22.1N.

And finally, an average of the extension values thus measured has been calculated so as to obtain the extension rate.

(2) Evaluation of the Extension Recovery Factor of a knit fabric:

The test specimens similar to those as used for evaluating the extension rate of the knit fabric, have been prepared and then each one of the specimens has been mounted on the above-mentioned constant rate of extension type tensile tester, with the same way as explained in (1).

After that, the extension has been measured at a time when a load applied to the specimen has reached at 14.7N, under the same steps and the same conditions as explained in (1), except for the load which is applied to the specimen at which the extension is measured.

Then, from the resulted values of the extension data, a set extension data of each one of the specimen is determined with reference to the following classification chart.

Thereafter, the specimen mounted on the constant rate of extension type tensile tester is suffered from the stretching and recovering operations under a rate of 30±2 cm, three times, so as to make a chart showing the extension recovery curves.

After that, from these charts of the extension recovery curves, a residual extension (L0) has been read out.

Finally, the extension recovery factor has been calculated utilizing the following equation with the above-mentioned set extension (L) and the above-mentioned residual extension (L0).

$$\text{Extension Recovery Factor}=(L-L0)/L\times 100$$

Wherein, L denotes the set extension, and
Lo denoted the residual extension

| | Measured extension | set extension |
|---|---|---|
| Three steps classification | Extension measured at a time when the load has reached at 14. 7 N, exceeds 80% | 80% |
| | Extension measured at a time when the load has reached at 14. 7 N, exceeds 60% but less than 80% | 60% |
| | Extension measured at a time when the load has reached at 14. 7 N, exceeds 40% but less than 60% | 40% |

(3) Evaluation of Peeling Strength of an Elastic Yarn:

After the elastic yarns have been entangled with each other to show loop like configuration, these entangled elastic yarns have been extended by 20% from its natural length (which means a length of the elastic yarn measured under a condition in that no tension is loaded on the elastic yarn).

Then, under this condition, the elastic yarns have been heat-set with dry heat for one minute at a temperature of 170° C. for "MOBILON" (Trademark)-R, and of 195° C. for "ROICA" (Trademark)-C805 and for "LYCRA" (Trademark)-T127C.

These specimens have been stretched so as to peel off the entangled elastic yarns from each other under the condition of a distance formed between the grippers being 5 cm and a moving rate of the grippers being 30 cm/minute with utilizing the above-mentioned constant rate of extension type tensile tester, (made by SHIMAZU SEISAKUSHO CO., LTD.) and a break strength thereof has been measured five time for respective specimen and finally, the averaged value of the break strength of the elastic yarns has been calculated.

(4) Evaluation of Curling of a Knit Fabric:

The three test specimens each having a vertical length of 16 cm and a lateral length of 2.5 cm and the three separate specimens each having a vertical length of 2.5 cm and a lateral length of 16 cm have been prepared by cutting them out from a knit fabric.

Then, each one of these specimens has been grasped by a chuck member (under the condition in that an upper gripping length of an upper gripper being 2.5 cm and a lower gripping length of a lower gripper being 3.5 cm as well as the distance formed between a pair of the grippers being 10 cm), and the respective specimen has been loaded with 500 g for 10 seconds.

After removing the load, the respective specimen has been left on a horizontal surface of a stand freely for 5 minutes, Thereafter, a width of a center portion of the respective specimen which is an intermediate portion between both grippers (that means a portion locating 5 cm from the upper gripper) and is placed on the stand, has been measured.

This length is referred as L' cm.

Then a curling rate (%) is calculated with the following formula, such as;

$$\text{a curling rate (\%)}=(2.5-L')/2.5\times 100$$

(5) Evaluation of Run of a Knit Fabric:

A cutting line has been inserted on a knitting end portion of a raw knit fabric in a wale direction and then the knitted loops located nearby the cutting line are rubbed with a nail of an operator.

After that, a condition about a generation of the run has been evaluated with visual inspection.

○ (good) No rum is generated from the cut end:

x (not good) Run is generated from the cut end:

(6) The Thermal Deformation Starting Temperature of the Elastic Yarn;

Two jigs, each having a hooking member, are mounted on a thermal shrink stress measuring tester sold by KANEBO ENGINEELING CO., LTD., in a vertically, one being arranged on an upper portion thereof and other being arranged on a lower portion thereof.

Then, an elastic yarn to be measured has been wound between the upper and the lower hooks by 10 times to make a hank reel.

After that, under this condition, the elastic yarn in the hank reeled condition, first has been loaded with an initial load of 20 cN and successively it has been heated with a temperature of an atmosphere of the elastic yarn being increased by 2.2° C./sec.

During this heating operation, a stress of the elastic yarn has been continuously measured and in this way, a temperature of the atmosphere when the measured stress of the elastic yarn has reached again to the stress of 20 cN.

This temperature has been measured two times and an averaged value thereof was determined as the thermal deformation starting temperature of the elastic yarn.

(7) Evaluation of Degradation of a Knit Fabric;

A break strength of a knit fabric, which has been treated with after-treatments, has been measured and evaluated along the measuring method as defined by JIS L1018A.

○ (good) A break strength thereof exceeds 150 kpa;

x (not good) A break strength thereof is less than 150 kpa;

(8) Evaluation of Dignity of a Surface of a Knit Fabric:

The dignity of the surface of the knit fabric has been evaluated by counting a number of "megaeri" in Japanese, of an elastic yarn in a double knit fabric among 100 loops formed in an area of the knit fabric, comprising 10 wales by 10 courses.

Note that although, a elastic double knit fabric is knitted with a non-elastic yarn and an elastic yarn each being fed to a knitting point simultaneously and both yarns are simultaneously knitted to form a loop, at this situation, if a balance in a tension or a deci tex between both yarns would have been broken, the elastic yarn would come up to a surface of the loops of the knit fabric, nevertheless, the elastic yarn should theoretically be hidden behind a loop formed by the non-elastic yarn, so that the elastic yarn can be seen from the surface of the knit fabric.

This situation is called as the "megaeri".

When this situation has been generated, after dyeing process has been completed, the configuration of the elastic yarn is remarkably recognized due to a difference in dyeability between the elastic yarn and the non-elastic yarn.

Accordingly, this causes to deteriorate the dignity of the knit fabric.

○ (good) Number of the "megaeri" is less than 29.

x (not good) Number of the "megaeri" exceeds less 30.

Example 1

Utilizing a double circular knitting machine (38 inch diameter and 40 gauge) made by FUKUHARA SEIKI SEISAKUSSHO CO., LTD., a double knitted fabric has been knitted with a Nylon filament yarn 13 dtex, 7 f (filaments) and a polyurethane elastic yarn 22 dtex ("ROICA"(Trademark) C805, made by ASAHI KASEI SENI CO., LTD., having the thermal deformation starting temperature being 152° C.), each of yarns having been fed from the same feeder to both of the dial needles and the cylinder needles, respectively, utilizing an interlock stitch so that the Nylon filament yarns are appeared on both external surfaces of the knit fabric, while the polyurethane yarns are arranged on both inner surfaces thereof.

Thereafter, the double knitted fabric has been scoured followed by a dipping process in which the knitted fabric has been dipped into a processing aqueous liquid comprising sodium benzenesulfonate 4.0 wt %, tartaric acid 1.0 wt % as fixed acid, EDTA 0.1 wt % as chelating agent, at normal temperature for 5 seconds.

After that, the knitted fabric has been dry-heat-set at temperature of 195° C., for one minute and then it has been dyed in a jet dyeing machine with a dyestuff comprising Aminyl Yellow FD-3RL (made by SUMITOMO KAGAKU KOUGYOU CO., LTD.) 0.3% o.w.f. (on weight fabric), Aminyl Red FD-GL (made by SUMITOMO KAGAKU KOUGYOU CO., LTD.) 0.3% o.w.f., Aminyl Blue FD-GL (made by SUMITOMO KAGAKU KOUGYOU CO., LTD.) 0.3% o.w.f., at 100° C. with a normal processing way.

After that, the knitted fabric has been finally set so that the double knit fabric with a finished density of 130 courses/inch and 73 wales/inch, has been obtained.

The results of the evaluation with respect to the knitted fabric thus obtained are shown in the Table 1.

Example 2

Utilizing a double circular knitting machine (38 inch diameter and 40 gauge) made by FUKUHARA SEIKI SEISAKUSSHO CO., LTD., a double knitted fabric has been knitted with a Nylon filament yarn 33 dtex, 24 f (filaments) and a polyurethane elastic yarn 22 dtex ("ROICA" (Trademark) C805, made by ASAHI KASEI SENI CO., LTD., having the thermal deformation starting temperature being 152° C.), each of yarns having been fed from the same feeder to both of the dial needles and the cylinder needles, respectively, utilizing an interlock stitch so that the Nylon filament yarns are appeared on both external surfaces of the knit fabric, while the polyurethane yarns are arranged on both inner surfaces thereof.

Thereafter, the double knitted fabric has been processed with the same treatment as indicated in the Example 1, so that the double knit fabric with a finished density of 110 courses/inch and 70 wales/inch, has been obtained.

The results of the evaluation with respect to the knitted fabric thus obtained are shown in the Table 1.

Example 3

Utilizing a double circular knitting machine (38 inch diameter and 40 gauge) made by FUKUHARA SEIKI SEISAKUSSHO CO., LTD., a double knitted fabric has been knitted with a Nylon filament yarn 13 dtex, 7 f (filaments) and a polyurethane elastic yarn 33 dtex ("ROICA" (Trademark) C805, made by ASAHI KASEI SENI CO., LTD., having the thermal deformation starting temperature being 152° C.), each of yarns having been fed from the same feeder to both of the dial needles and the cylinder needles, respectively, utilizing an interlock stitch so that the Nylon filament yarns are appeared on both external surfaces of the knit fabric, while the polyurethane yarns are arranged on both inner surfaces thereof.

Thereafter, the double knitted fabric has been processed with the same treatment as indicated in the Example 1, so that the double knit fabric with a finished density of 100 courses/inch and 70 wales/inch, has been obtained.

The results of the evaluation with respect to the knitted fabric thus obtained are shown in the Table 1.

Example 4

Utilizing a double circular knitting machine (38 inch diameter and 40 gauge) made by FUKUHARA SEIKI SEISAKUSSHO CO., LTD., a double knitted fabric has been knitted with a Nylon filament yarn 55 dtex, 34 f (filaments) and a polyurethane elastic yarn 22 dtex ("ROICA" (Trademark) C805, made by ASAHI KASEI SENI CO., LTD., having the thermal deformation starting temperature being 152° C.), each of yarns having been fed from the same feeder to both of the dial needles and the cylinder needles, respectively, utilizing an interlock stitch so that the Nylon filament yarns are appeared on both external surfaces of the knit fabric, while the polyurethane yarns are arranged on both inner surfaces thereof.

Thereafter, the double knitted fabric has been processed with the same treatment as indicated in the Example 1, so that the double knit fabric with a finished density of 80 courses/inch and 63 wales/inch, has been obtained.

The results of the evaluation with respect to the knitted fabric thus obtained are shown in the Table 1.

Example 5

Utilizing a double circular knitting machine (38 inch diameter and 40 gauge) made by FUKUHARA SEIKI SEISAKUSSHO CO., LTD., a double knitted fabric has been knitted with a Nylon filament yarn 13 dtex, 7 f (filaments) and a polyurethane elastic yarn 22 dtex ("LYCRA" (Trademark) T-127C, made by OPELON TEX CO., LTD., having the thermal deformation starting temperature being 165° C.), each of yarns having been fed from the same feeder to both of the dial needles and the cylinder needles, respectively, utilizing an interlock stitch so that the Nylon filament yarns are appeared on both external surfaces of the knit fabric, while the polyurethane yarns are arranged on both inner surfaces thereof.

Thereafter, the double knitted fabric has been processed with the same treatment as indicated in the Example 1, so that the double knit fabric with a finished density of 128 courses/inch and 71 wales/inch, has been obtained.

The results of the evaluation with respect to the knitted fabric thus obtained are shown in the Table 1.

Example 6

The double knitted fabric has been obtained by processing the double knitted fabric as obtained in the Example 1, with the same treatment as indicated in the Example 1 except for the dry heat set temperature of 200° C.

The results of the evaluation with respect to the knitted fabric thus obtained are shown in the Table 1.

Example 7

Utilizing a double circular knitting machine (38 inch diameter and 40 gauge) made by FUKUHARA SEIKI SEISAKUSSHO CO., LTD., a double knitted fabric has been knitted with a Nylon filament yarn 22 dtex, 7 f (filaments) and a polyurethane elastic yarn 44 dtex ("LYCRA" (Trademark) T-127C, made by OPELON TEX CO., LTD., having the thermal deformation starting temperature being 188° C.), each of yarns having been fed from the same feeder to both of the dial needles and the cylinder needles, respectively, utilizing an interlock stitch so that the Nylon filament yarns are appeared on both external surfaces of the knit fabric, while the polyurethane yarns are arranged on both inner surfaces thereof.

Thereafter, the double knitted fabric has been processed with the same treatment as indicated in the Example 1, so that the double knit fabric with a finished density of 118 courses/inch and 66 wales/inch, has been obtained.

The results of the evaluation with respect to the knitted fabric thus obtained are shown in the Table 1.

Comparative Example 1

Utilizing a double circular knitting machine (38 inch diameter and 40 gauge) made by FUKUHARA SEIKI SEISAKUSSHO CO., LTD., a double knitted fabric has been knitted with a Nylon filament yarn 33 dtex, 24 f (filaments) and a thermal fusible polyurethane elastic yarn 22 dtex ("MOBILON" (Trademark) R, made by NISSHIN BOSEKI CO., LTD., having the thermal deformation starting temperature being 74° C.), each of yarns having been fed from the same feeder to both of the dial needles and the cylinder needles, respectively, utilizing an interlock stitch so that the Nylon filament yarns are appeared on both external surfaces of the knit fabric, while the polyurethane yarns are arranged on both inner surfaces thereof.

Thereafter, the double knitted fabric has been scoured followed by a dipping process in which the knitted fabric has been dipped into a processing aqueous liquid comprising sodium benzenesulfonate 4.0 wt %, tartaric acid 1.0 wt % as fixed acid and EDTA 0.1 wt % as chelating agent, at normal temperature for 5 seconds.

After that, the knitted fabric has been dry-heat-set at temperature of 170° C., for one minute so that the polyurethane yarns have been welded to each other and then it has been processed with the same dyeing and finishing treatment as indicated in the Example 1, so that the double knit fabric with a finished density of 95 courses/inch and 70 wales/inch, has been obtained.

The results of the evaluation with respect to the knitted fabric thus obtained are shown in the Table 2.

Comparative Example 2

Utilizing a double circular knitting machine (38 inch diameter and 40 gauge) made by FUKUHARA SEIKI SEISAKUSSHO CO., LTD., a double knitted fabric has been knitted with a Nylon filament yarn 13 dtex, 7 f (filaments) and a polyurethane elastic yarn 22 dtex ("ROICA"(Trademark) C805, made by ASAHI KASEI SENI CO., LTD., having the thermal deformation starting temperature being 152° C.), each of yarns having been fed from the same feeder to both of the dial needles and the cylinder needles, respectively, utilizing an interlock stitch.

Thereafter, the double knitted fabric has been processed with the same treatment as indicated in the Example 1, so that the double knit fabric with a finished density of 110 courses/inch and 65 wales/inch, has been obtained.

The results of the evaluation with respect to the knitted fabric thus obtained are shown in the Table 2.

Comparative Example 3

Utilizing a double circular knitting machine (38 inch diameter and 32 gauge) made by FUKUHARA SEIKI SEISAKUSSHO CO., LTD., a double knitted fabric has been knitted with a Nylon filament yarn 77 dtex, 36 f (filaments) and a polyurethane elastic yarn 22 dtex ("ROICA"(Trademark) C805, made by ASAHI KASEI SENI CO., LTD., having the thermal deformation starting temperature being 152° C.), each of yarns having been fed from the same feeder to both of the dial needles and the cylinder needles, respectively, utilizing an interlock stitch so that the Nylon filament yarns are appeared on both external surfaces of the knit fabric, while the polyurethane yarns are arranged on both inner surfaces thereof.

Thereafter, the double knitted fabric has been processed with the same treatment as indicated in the Example 1, so that the double knit fabric with a finished density of 80 courses/inch and 60 wales/inch, has been obtained.

The results of the evaluation with respect to the knitted fabric thus obtained are shown in the Table 2.

Comparative Example 4

Utilizing a double circular knitting machine (38 inch diameter and 40 gauge) made by FUKUHARA SEIKI SEISAKUSSHO CO., LTD., a double knitted fabric has been knitted with a Nylon filament yarn 13 dtex, 7 f (filaments) and a polyurethane elastic yarn 55 dtex ("LYCRA" (Trademark) T-127C, made by OPELON TEX CO., LTD., having the thermal deformation starting temperature being 188° C.), each of yarns having been fed from the same feeder to both of the dial needles and the cylinder needles, respectively, utilizing an interlock stitch so that the Nylon filament yarns are appeared on both external surfaces of the knit fabric, while the polyurethane yarns are arranged on both inner surfaces thereof.

Thereafter, the double knitted fabric has been processed with the same treatment as indicated in the Example 1, so that the double knit fabric with a finished density of 83 courses/inch and 62 wales/inch, has been obtained.

The results of the evaluation with respect to the knitted fabric thus obtained are shown in the Table 2.

Comparative Example 5

Utilizing a double circular knitting machine (38 inch diameter and 32 gauge) made by FUKUHARA SEIKI SEISAKUSSHO CO., LTD., a double knitted fabric has been knitted with a Nylon filament yarn 55 dtex, 34 f (filaments) and a polyurethane elastic yarn 22 dtex ("ROICA"(Trademark) C805, made by ASAHI KASEI SENI CO., LTD., having the thermal deformation starting temperature being 152° C.), each of yarns having been fed from the same feeder to both of the dial needles and the cylinder needles, respectively, utilizing an interlock stitch, so that the Nylon filament yarns are appeared on both external surfaces of the knit fabric, while the polyurethane yarns are arranged on both inner surfaces thereof.

Thereafter, the double knitted fabric has been processed with the same treatment as indicated in the Example 1, so that the double knit fabric with a finished density of 75 courses/inch and 60 wales/inch, has been obtained.

The results of the evaluation with respect to the knitted fabric thus obtained are shown in the Table 2.

Comparative Example 6

Utilizing a single circular knitting machine (38 inch diameter and 36 gauge) made by FUKUHARA SEIKI SEISAKUSSHO CO., LTD., a single knitted fabric has been knitted with a Nylon filament yarn 33 dtex, 24 f (filaments) and a polyurethane elastic yarn 44 dtex ("ROICA"(Trademark) C805, made by ASAHI KASEI SENI CO., LTD., having the thermal deformation starting temperature being 152° C.), each of yarns having been fed from the same feeder to the dial needles, simultaneously, with a bare plain stitch utilizing a plaiting method.

Thereafter, the single knitted fabric has been processed with the same treatment as indicated in the Example 1, so that the single knit fabric with a finished density of 124 courses/inch and 69 wales/inch, has been obtained.

The results of the evaluation with respect to the knitted fabric thus obtained are shown in the Table 2.

TABLE 1

| | Example 1 | Example 2 | Example 3 | Example 4 | Example 5 | Example 6 | Example 7 |
|---|---|---|---|---|---|---|---|
| Kind of yarn | Ny13dtex7f | Ny33dtex24f | Ny13dtex7f | Ny55dtex34f | Ny13dtex7f | Ny13dtex7f | Ny22dtex7f |
| Fineness of yarn | "Roica"22dtex | "Roica"22dtex | "Roica"33dtex | "Roica"22dtex | "Lycra"22dtex | "Roica"22dtex | "Lycra"44dtex |
| Gauge of knitting machine | 40 | 40 | 40 | 40 | 40 | 40 | 40 |
| Yarn fineness ratio (Elastic:Non-elastic) | 1:0.59 | 1:1.5 | 1:0.39 | 1:2.5 | 1:0.59 | 1:0.59 | 1:0.5 |
| Set temperature | 195° C. | 195° C. | 195° C. | 195° C. | 195° C. | 200° C. | 195° C. |
| Density(course/wale) | 130/73 | 110/70 | 100/70 | 80/63 | 128/71 | 130/73 | 118/66 |
| Product of density | 9490 | 7700 | 7000 | 5040 | 9088 | 9490 | 7788 |
| Extension Rate(%)(warp/weft) | 280/300 | 260/290 | 235/225 | 180/180 | 260/280 | 255/260 | 210 × 225 |
| Extension Recovery Factor(%)(warp/weft) | 96/96 | 94.4/93.3 | 93/92 | 92/92 | 95/95 | 96/96 | 95/97 |
| Curling Rate(%)(warp/weft) | 3/0 | 5/2 | 5/5 | 5/5 | 3/0 | 3/0 | 2/0 |
| Peeling strength(cN) | 10.5 | 10.5 | 13.4 | 10.5 | 10.3 | 10.5 | 15.1 |
| Degradation of a knit fabric | ○ | ○ | ○ | ○ | ○ | ○ | ○ |
| Condition of run | ○ | ○ | ○ | ○ | ○ | ○ | ○ |
| Dignity of a surface of a fabric | ○ | ○ | ○ | ○ | ○ | ○ | ○ |

TABLE 2

| | Comparative Example 1 | Comparative Example 2 | Comparative Example 3 | Comparative Example 4 | Comparative Example 5 | Comparative Example 6 |
|---|---|---|---|---|---|---|
| Kind of yarn | Ny33dtex24f | Ny13dtex7f | Ny77dtex36f | Ny13dtex7f | Ny55dtex34f | Ny33dtex24f |
| Fineness of yarn | "Mobilon"22dtex | "Roica"22dtex | "Roica"22dtex | "Lycra"55dtex | "Roica"22dtex | "Roica"44dtex |
| Gauge of knitting machine | 40 | 40 | 32 | 40 | 32 | 36 |
| Yarn fineness ratio (Elastic:Non-elastic) | 1:1.5 | 1:0.59 | 1:3.5 | 1:0.24 | 1:2.5 | 1:0.75 |
| Set temperature | 170° C. | 195° C. | 195° C. | 195° C. | 195° C. | 195° C. |
| Density(course/wale) | 95/70 | 110/65 | 80/60 | 83/62 | 75/60 | 124/69 |
| Product of density | 6650 | 7150 | 4800 | 5146 | 4500 | 8556 |
| Extension Rate(%)(warp/weft) | 150 × 220 | 130 × 260 | 110/150 | 145/155 | 140/170 | 238/224 |
| Extension Recovery Factor(%)(warp/weft) | 93.8/93.8 | 89.3/90 | 85.5/87.5 | 93/92 | 92/92 | 88.8/89.7 |

TABLE 2-continued

| | Comparative Example 1 | Comparative Example 2 | Comparative Example 3 | Comparative Example 4 | Comparative Example 5 | Comparative Example 6 |
|---|---|---|---|---|---|---|
| Curling Rate(%)(warp/weft) | 5/4 | 70/60 | 5/5 | 5/5 | 5/5 | 60/40 |
| Peeling strength(cN) | 22.4 | 10.5 | 10.5 | 19.6 | 10.5 | 15.4 |
| Degradation of a knit fabric | ○ | ○ | ○ | ○ | ○ | ○ |
| Condition of rum | ○ | X | X | ○ | X | X |
| Dignity of a surface of a fabric | ○ | ○ | ○ | X | ○ | ○ |

The invention claimed is:

1. A double knit fabric having a superior run and curling generation preventing ability, made by a weft knitting process utilizing a non-elastic yarn and an elastic yarn having thermal deformation starting temperature of 150° C. to 190° C., with a plating stitch so that the non elastic yarn is arranged on both external surfaces of the double knit fabric while the elastic yarn is arranged on both inner surfaces thereof, and wherein said weft knit fabric further has a ratio of a size of said elastic yarn as used in said knit fabric to that of the non-elastic yarn as used in said knit fabric, being 1:0.3 to 1:3.0, and an extension rate of said knit fabric is 180% or more, while an extension recovery factor thereof is 92% or more, as well as a product of a warp density and a weft density of said knit fabric is 5000/square inch or more.

2. A double knit fabric according to claim 1, wherein a peeling strength of a portion on which the elastic yarns are contacted with each other, is 10 cN to 17 cN.

3. A double knit fabric according to claim 1, wherein said double weft knit fabric is further characterized in that said knit fabric is produced with utilizing a knit configuration based on an interlock stitch.

4. A method to process a double knit fabric comprising a step of providing double knit fabric having a superior run and curling generation preventing ability, made by a weft knitting process utilizing a non-elastic yarn and an elastic yarn having thermal deformation starting temperature of 150° C. to 190° C., with a plating stitch so that the non elastic yarn is arranged on both external surfaces of the double knit fabric while the elastic yarn is arranged on both inner surfaces thereof, and wherein said weft knit fabric further has a ratio of a size of said elastic yarn as used in said knit fabric to that of the non-elastic yarn as used in said knit fabric, being 1:0.3 to 1:3.0, and an extension rate of said knit fabric is 180% or more, while an extension recovery factor thereof is 92% or more, as well as a product of a warp density and a weft density of said knit fabric is 5000/square inch or more, a step of treating said double knit fabric with a treatment liquid including sulfonate, and a step of heat-setting the treated double knit fabric at the temperature of 195° C. to 205° C.

5. A double knit fabric according to claim 2, wherein said double knit fabric is further characterized in that said knit fabric is produced with utilizing a knit configuration based on an interlock stitch.

6. A method to process a double knit fabric comprising a step of providing double knit fabric having a superior run and curling generation preventing ability, made by a weft knitting process utilizing a non-elastic yarn and an elastic yarn having thermal deformation starting temperature of 150° C. to 190° C., with a plating stitch so that the non elastic yarn is arranged on both external surfaces of the double knit fabric while the elastic yarn is arranged on both inner surfaces thereof, and wherein said weft knit fabric further has a ratio of a size of said elastic yarn as used in said knit fabric to that of the non-elastic yarn as used in said knit fabric, being 1:0.3 to 1:3.0, and an extension rate of said knit fabric is 180% or more, while an extension recovery factor thereof is 92% or more, as well as a product of a warp density and a weft density of said knit fabric is 5000/square inch or more, wherein a peeling strength of a portion on which the elastic yarns are contacted with each other, is 10 cN to 17 cN, a step of treating said double knit fabric with a treatment liquid including sulfonate, and a step of heat-setting the treated double knit fabric at the temperature of 195° C. to 205° C.

7. A method to process a double knit fabric comprising a step of providing double knit fabric having a superior run and curling generation preventing ability, made by a weft knitting process utilizing a non-elastic yarn and an elastic yarn having thermal deformation starting temperature of 150° C. to 190° C., with a plating stitch so that the non elastic yarn is arranged on both external surfaces of the double knit fabric while the elastic yarn is arranged on both inner surfaces thereof, and wherein said weft knit fabric further has a ratio of a size of said elastic yarn as used in said knit fabric to that of the non-elastic yarn as used in said knit fabric, being 1:0.3 to 1:3.0, and an extension rate of said knit fabric is 180% or more, while an extension recovery factor thereof is 92% or more, as well as a product of a warp density and a weft density of said knit fabric is 5000/square inch or more, wherein said double weft knit fabric is further characterized in that said knit fabric is produced with utilizing a knit configuration based on an interlock stitch, a step of treating said double knit fabric with a treatment liquid including sulfonate, and a step of heat-setting the treated double knit fabric at the temperature of 195° C. to 205° C.

* * * * *